United States Patent [19]

Johnson

[11] 4,222,256

[45] Sep. 16, 1980

[54] STRAIGHTENER WITH INDIVIDUALLY REMOVABLE ROLL AND PIVOTED BEARING HOUSING AND ROLL DESIGN

[75] Inventor: Kenneth C. Johnson, Des Plaines, Ill.

[73] Assignee: F. J. Littell Machine Company, Chicago, Ill.

[21] Appl. No.: 13,027

[22] Filed: Feb. 21, 1979

[51] Int. Cl.[3] ..... B21D 1/02

[52] U.S. Cl. ..... 72/164; 72/165

[58] Field of Search ..... 72/164, 165, 163, 160, 72/181

[56] References Cited

U.S. PATENT DOCUMENTS

| | | | |
|---|---|---|---|
| 10,276 | 1/1883 | Seaman | 72/164 |
| 2,132,426 | 10/1938 | Maussnest | 72/165 X |
| 2,323,768 | 7/1943 | Hanna | 72/165 |

*Primary Examiner*—Milton S. Mehr

*Attorney, Agent, or Firm*—Russell H. Clark

[57] ABSTRACT

In the straightening machine of the invention, pivot plates are provided for mounting and pivotally supporting the upper movable rolls including the pinch rolls and the straightening rolls, whereby improved operation can be obtained. Expensive manufacturing costs can be reduced by employing pivot plates as disclosed by the present applicant. The task of maintenance is also reduced since fewer hours are needed for repairs whereas roll bearing capacity is materially increased. The pivot plates are pivotally supported by the side frames respectively having location adjacent the inside surface of the side frames and bearing units are mounted in the free ends of the pivot plates. It is possible to stagger the bearing units since the bearing units for the lower rolls are mounted for rotation in the side frames whereas the bearing units for the upper movable rolls are mounted in the pivot plates.

14 Claims, 10 Drawing Figures

Figure 1:
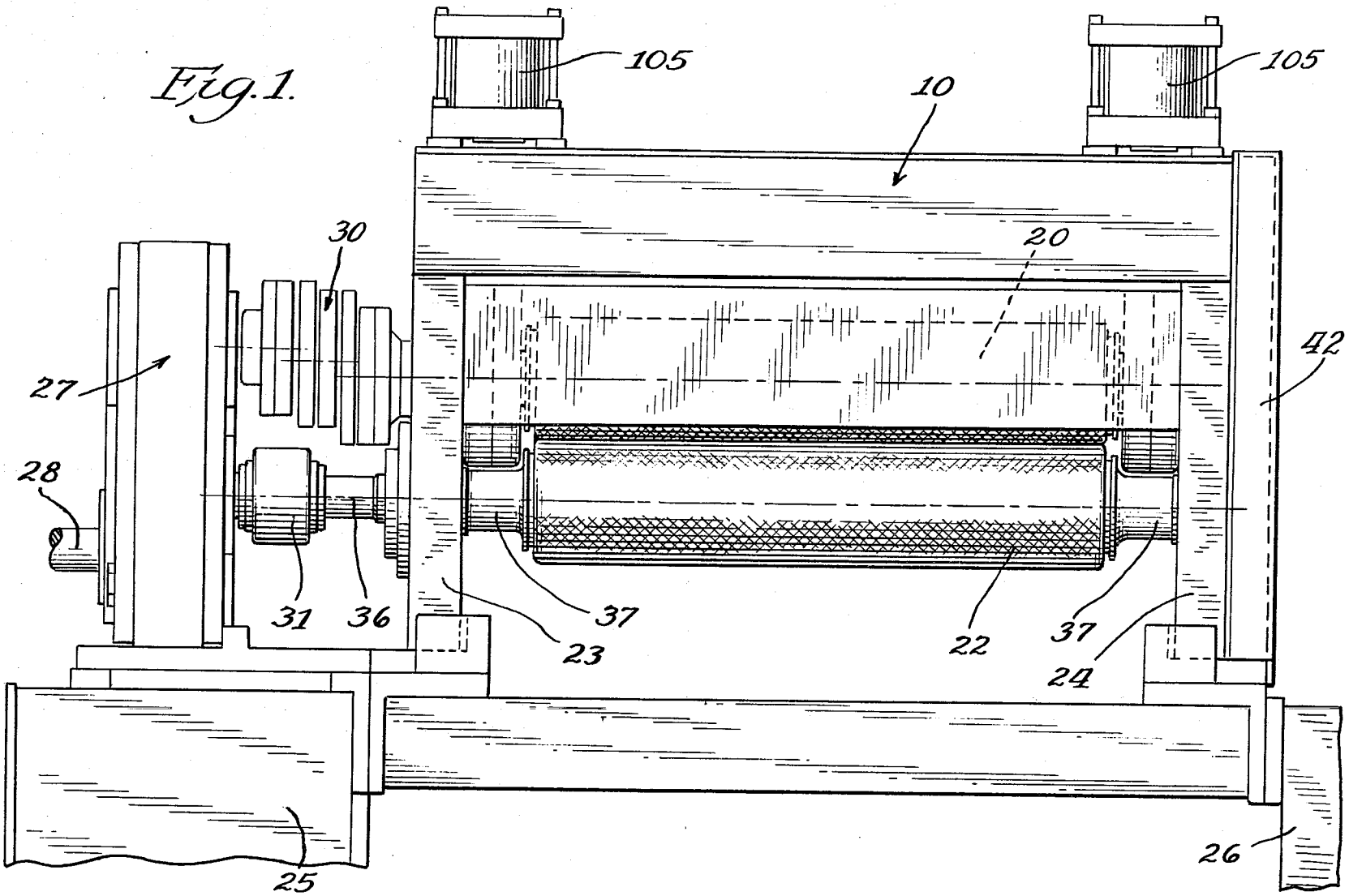

STRAIGHTENER WITH INDIVIDUALLY REMOVABLE ROLL AND PIVOTED BEARING HOUSING AND ROLL DESIGN

The invention relates to straightening machines for working and straightening metal strip material as it unwinds from a coil and has reference in particular to a straightener having pivot plates for mounting and pivotally supporting the movable rolls whereby improved operation is obtained with a reduction in expensive manufacturing costs although roll bearing capacity is increased and with ease of maintenance and reduced down time since fewer hours are needed for repairs.

Since pivot plates are employed in the straightener of the invention, the vertical guide slots as heretofore employed in the side frames are eliminated. The guide slots received the blocks which journalled the movable rolls. The guide slots required accurate and expensive machine work since the slots in respective side frames had to be accurately aligned and precisely machined for receiving a bearing block adapted to have sliding vertical movement.

In the present straightener all movable and adjustable rolls including the upper straightening rolls and the upper pinch rolls are journalled in bearings which in turn are carried by pivot plates in such a manner that the rolls can be easily removed through openings in the side frames.

Another objective of the invention is to provide an improved straightening machine of the character described and wherein pivot plates are employed, the same having a pivotal connection with the side frames respectively, and which in turn journal the ends of the movable rolls.

Another object of the invention is to provide pivot plates for journalling and mounting all movable rolls in a straightening machine and wherein all such movable rolls can be removed individually through openings in the side frames and in a manner without disturbing other rolls.

A further object of the invention resides in the provision of a straightener incorporating pivot plates as described and wherein the upper movable straightening rolls together with their bearings and bearing retainers can be respectively removed as a unit and without any bearing disassembly.

Another object is to provide a straightener for strip material which will incorporate pivot plates for pivotally supporting and mounting the movable rolls within the side frames and wherein an increase in roll bearing size without an increase in roll size or spacing from other rolls is made possible by off-setting the bearing structures for the upper straightening rolls to the inside of the bearing structure for the lower straightening rolls, respectively.

Another object is to provide a straightener which will be pivotal in a manner as described and wherein jack screw arrangements are employed for producing the adjustable movements of the upper straightening rolls and with power cylinder means being employed for producing the adjusting movements of the upper pinch rolls.

A further object is to provide a straightener which will incorporate pivot plates for the movable rolls and wherein certain pivot plates will carry a journal bearing within a journal bearing in order that the jack screws of the arrangements and also the piston rods of the power cylinders means may have straight line up and down movements notwithstanding the pivotal action of the pivot plates.

Another objective of the invention resides in providing visual indicators for the rolls of the straightener in order that the operator may have a visual indication of the rolls with respect to the pass gauge line.

With these and other objects in view, the invention may consist of certain novel features of construction and operation as will be more fully described and particularly pointed out in the drawings, specification and claims appended hereto.

In the drawings which illustrate an embodiment of the invention and wherein like reference characters are used to designate like parts.

Figure 2:
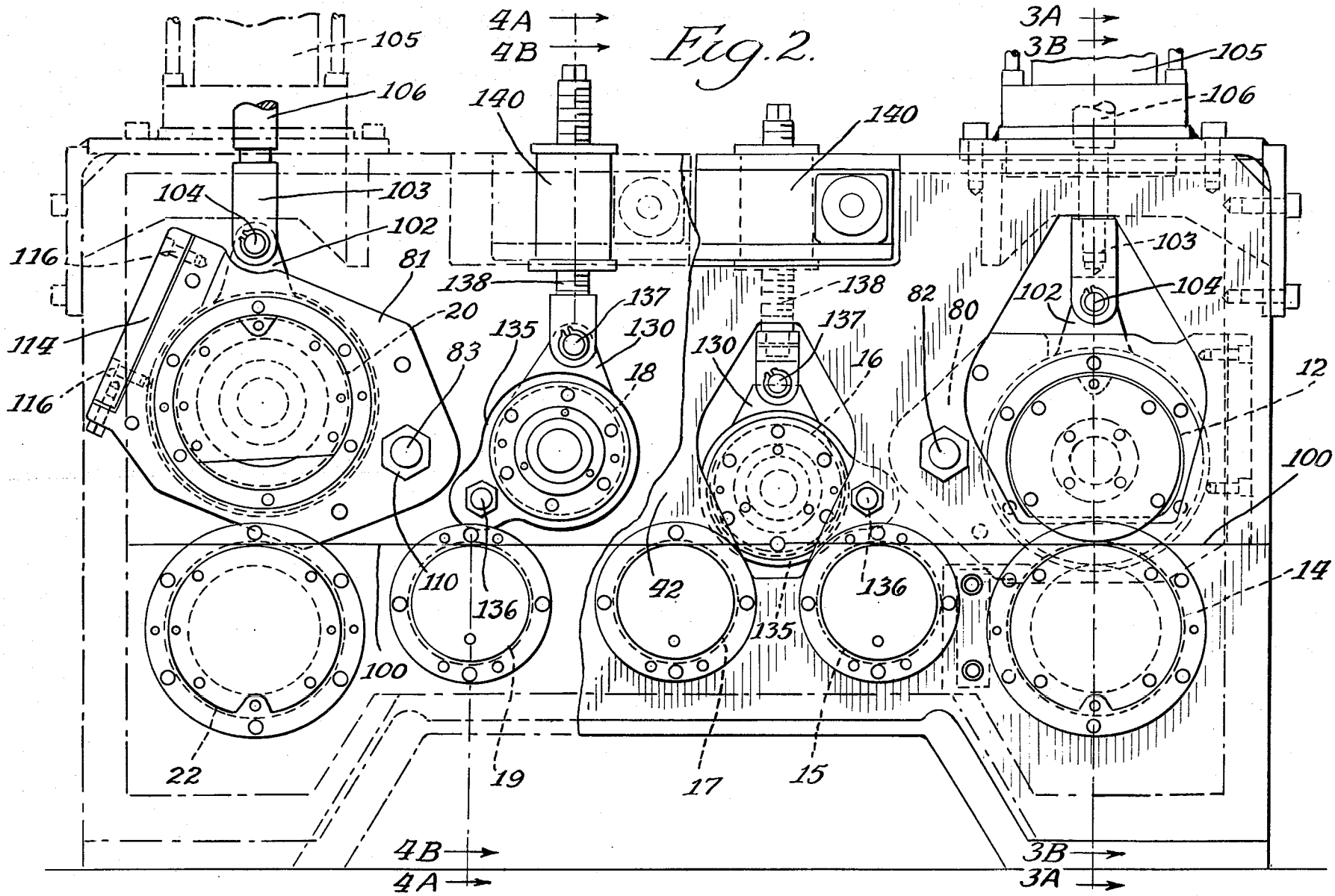
Figure 3A:
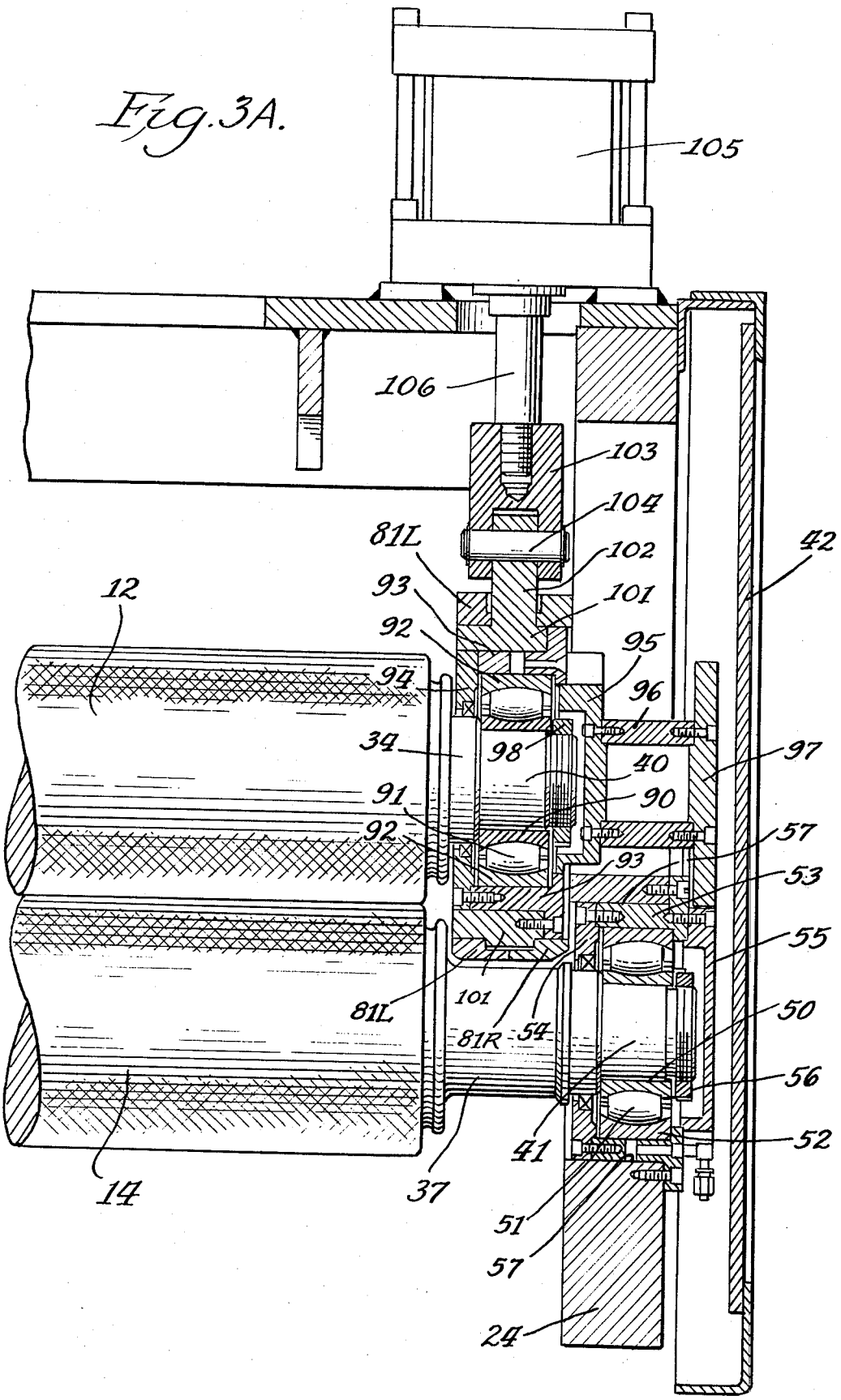
Figure 3B:
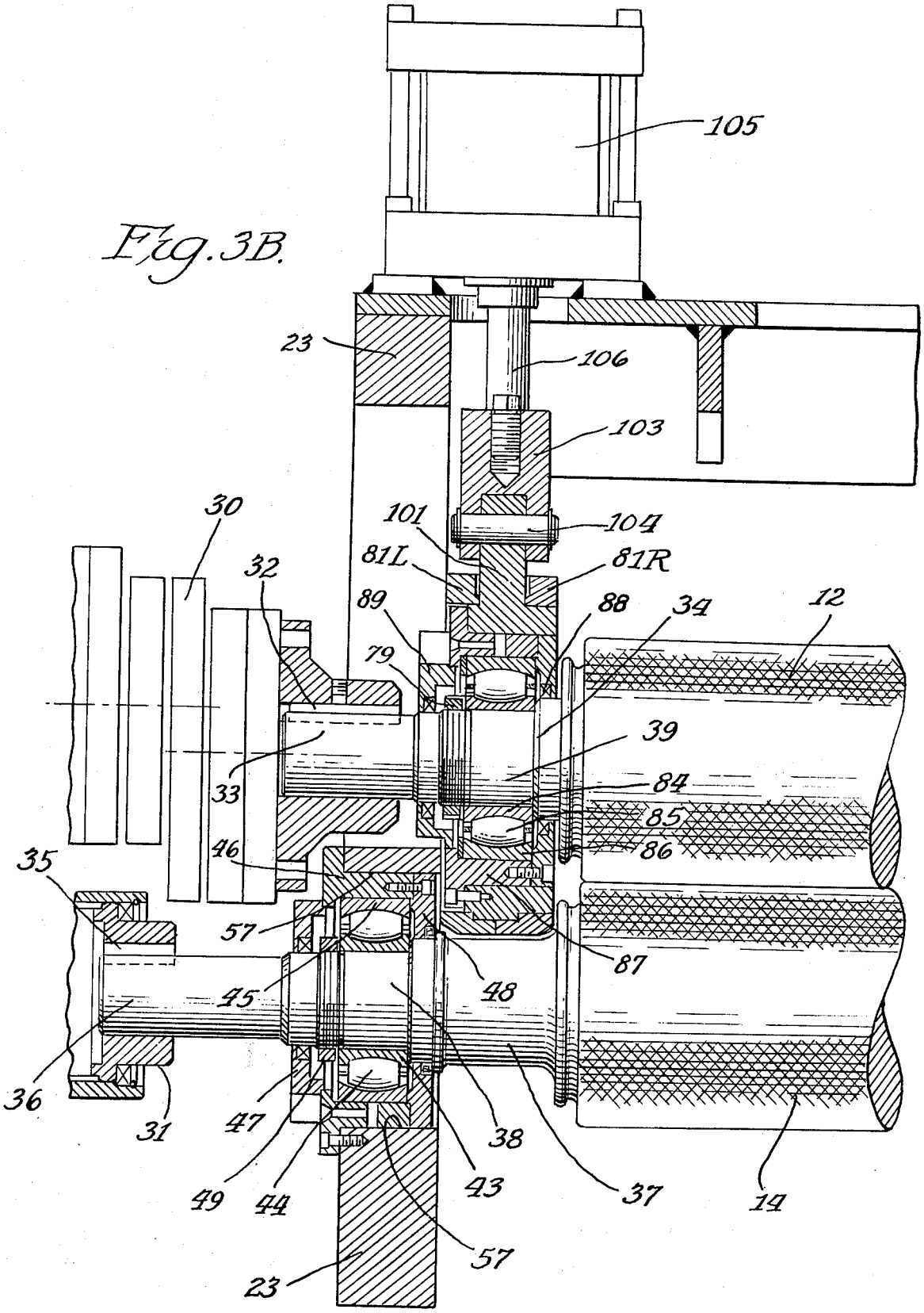
Figure 4A:
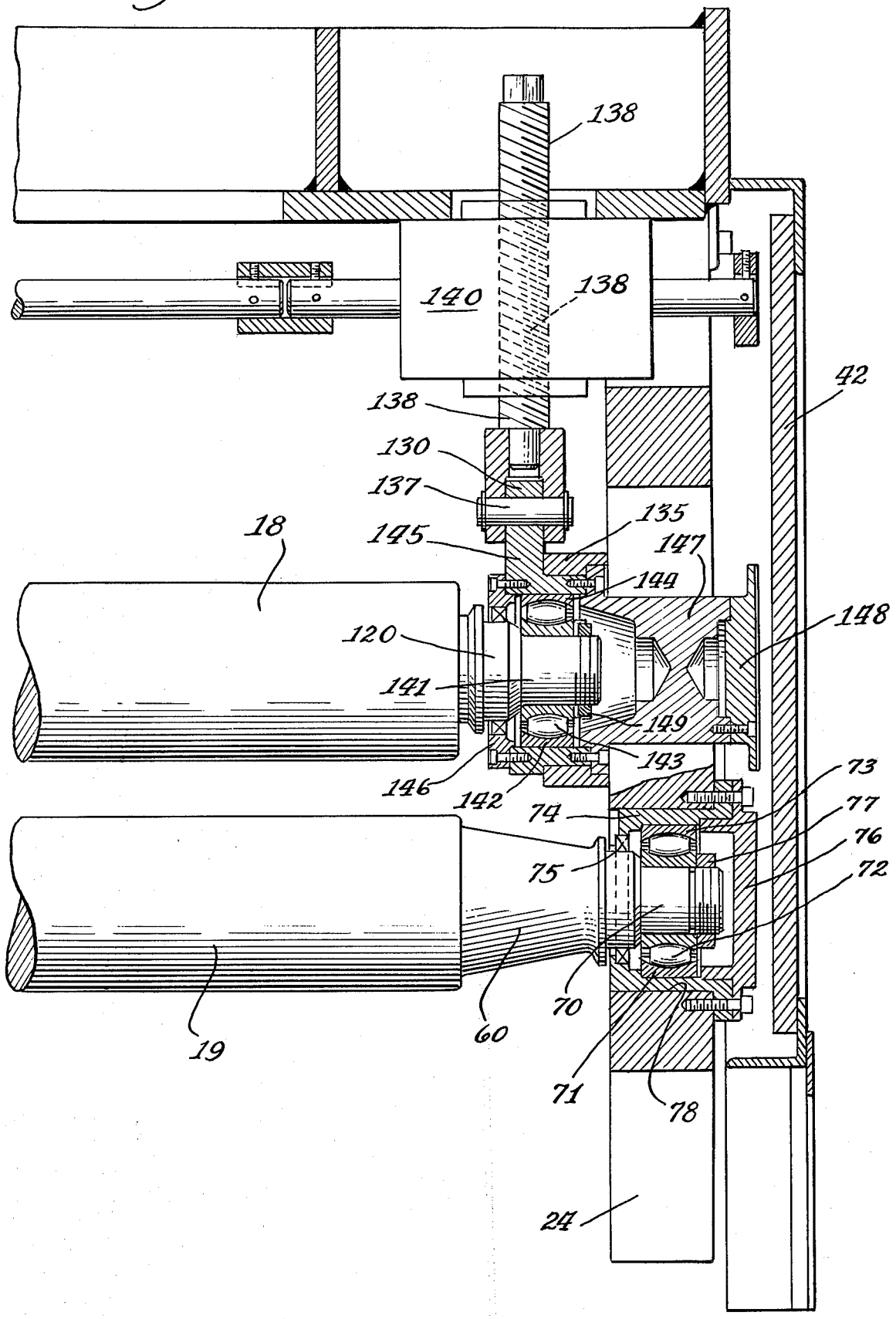
Figure 4B:
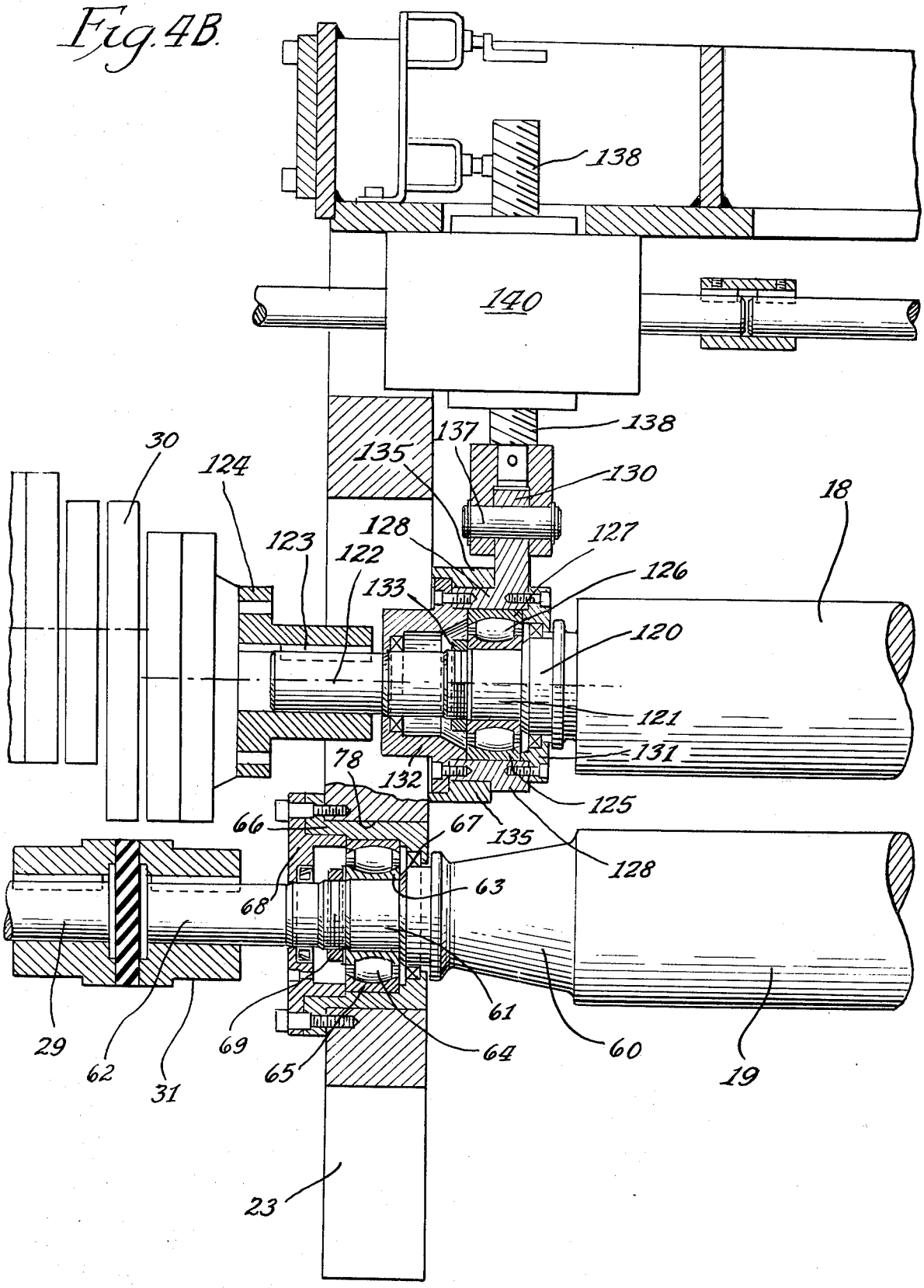
Figure 5:
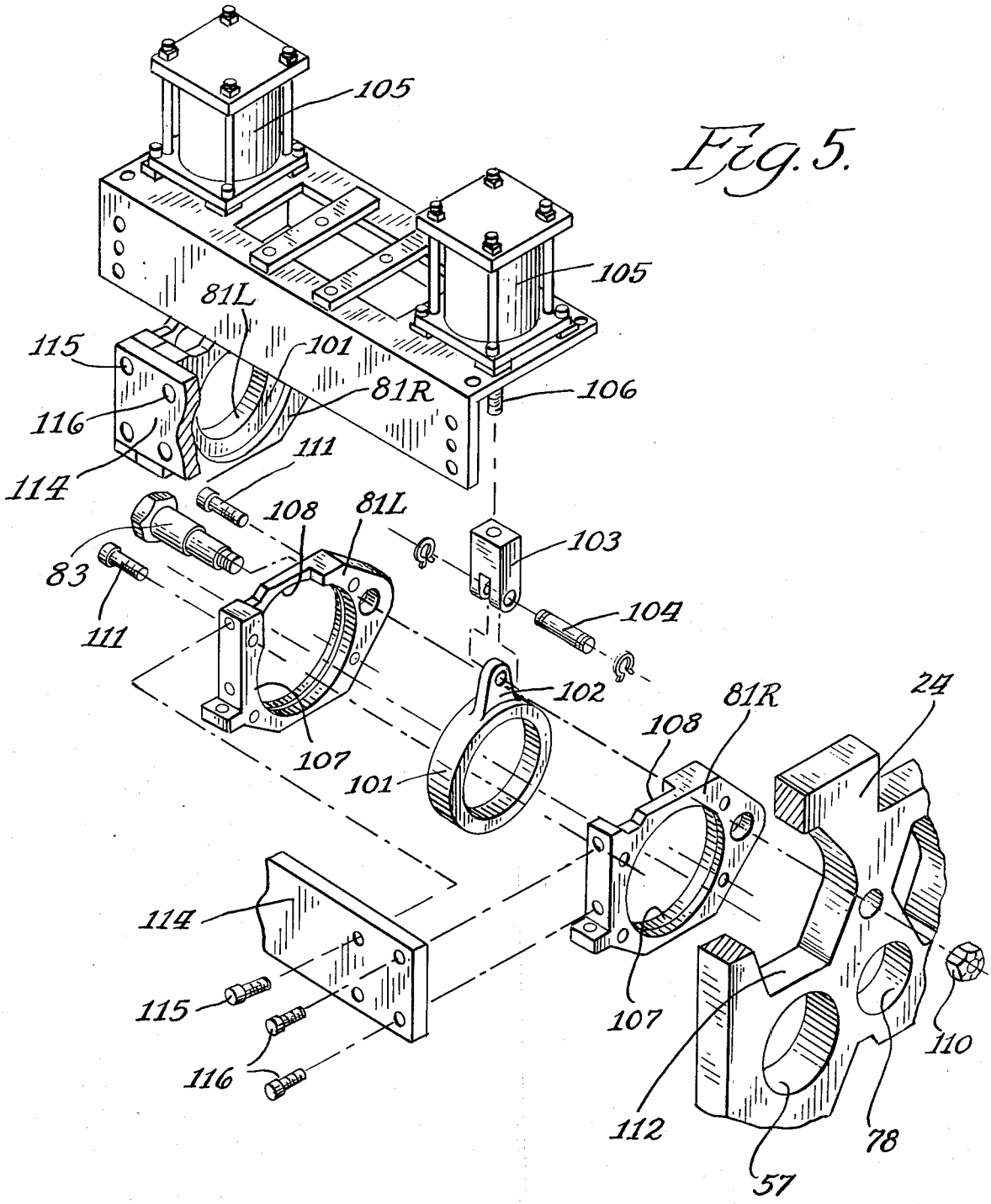
Figure 6:
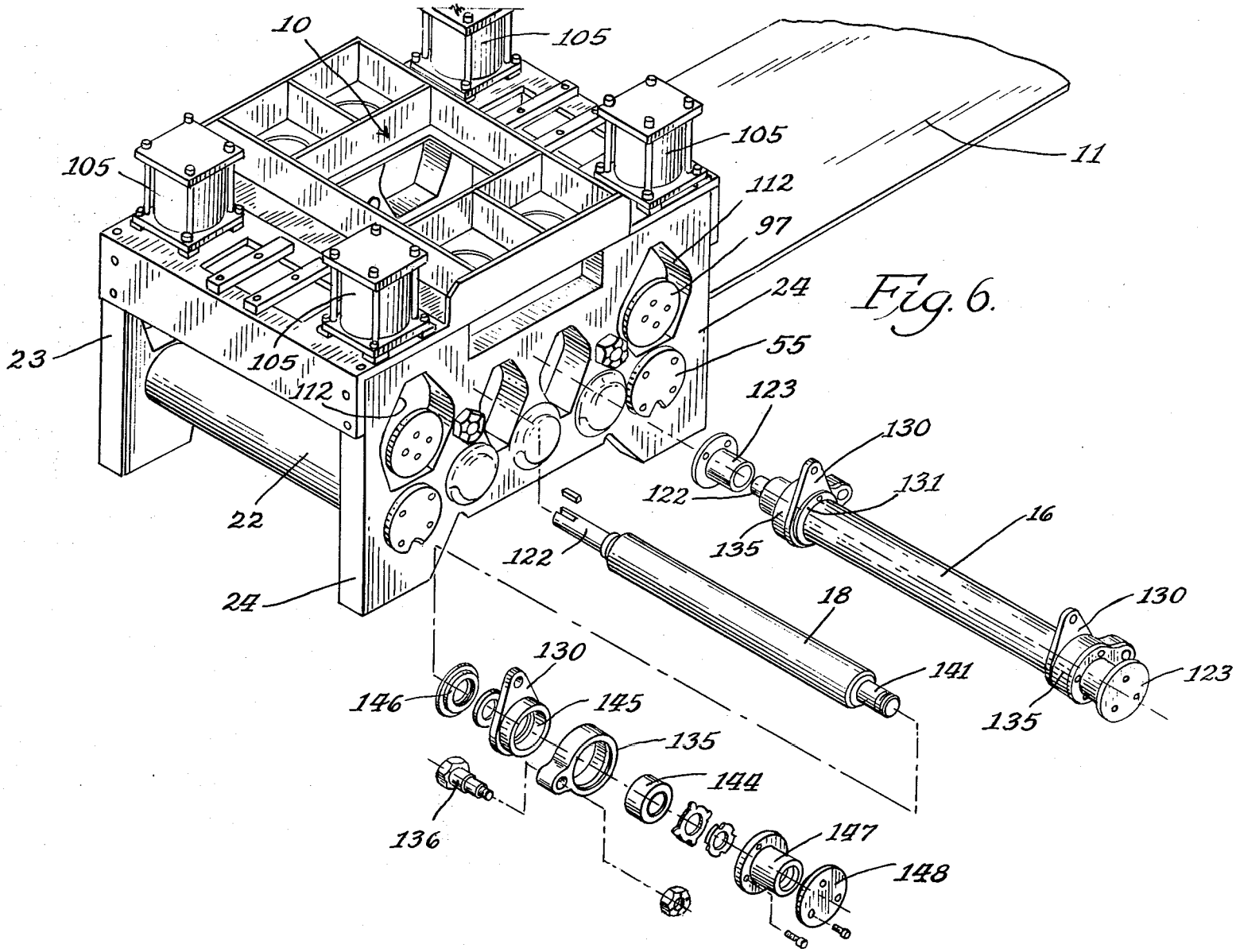
Figure 7:
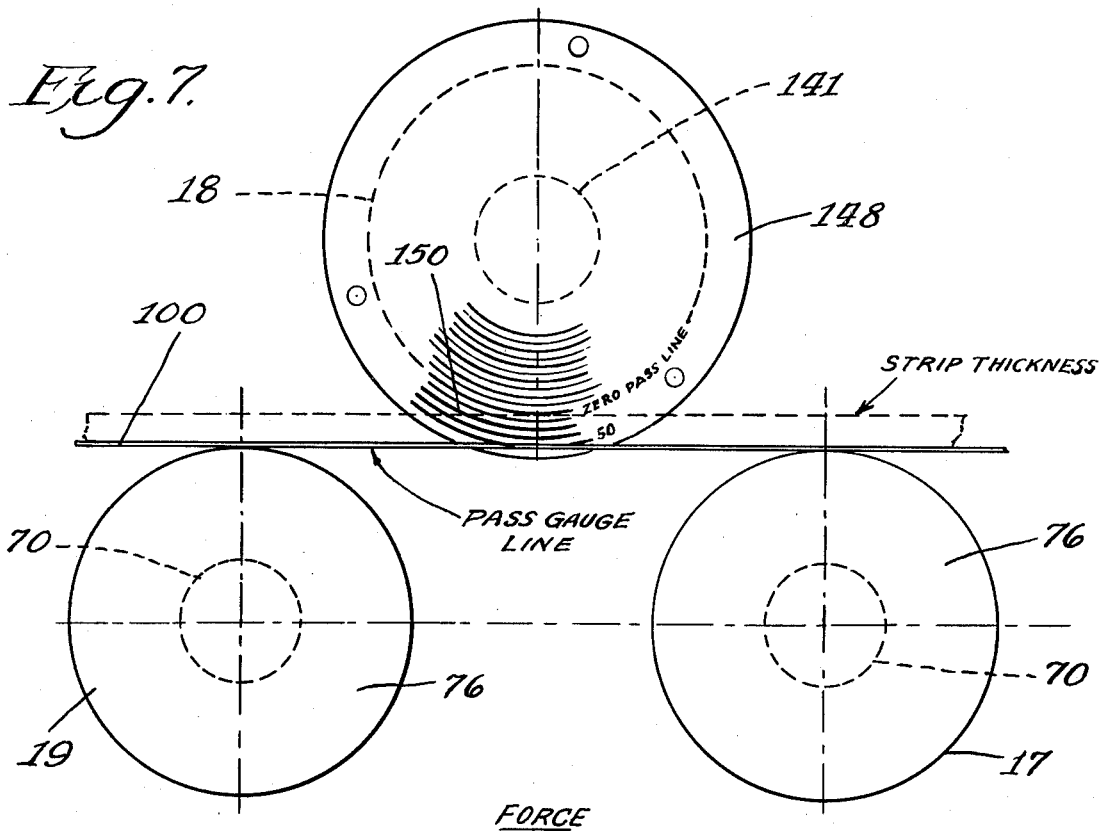
Figure 8:
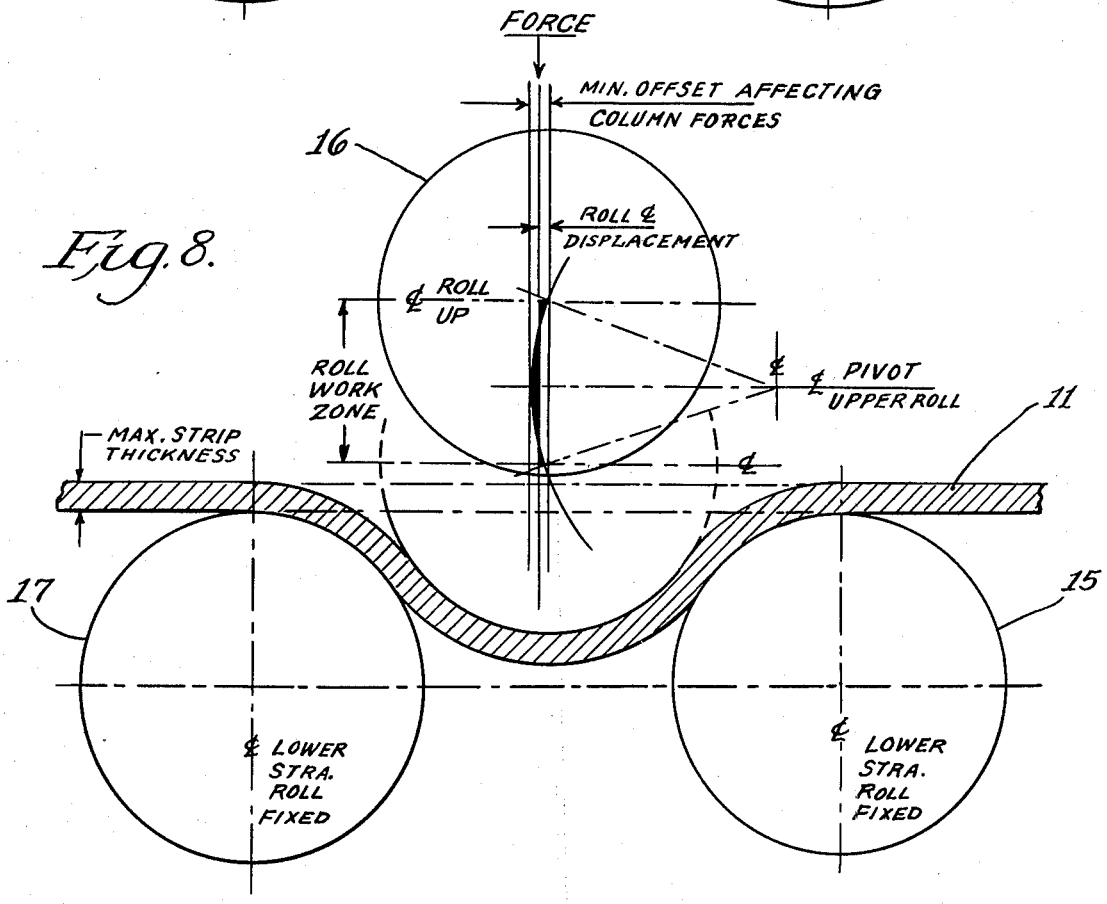

FIG. 1 is rear elevational view showing the straightener of the invention in operative connected relation with a gear box which provides the power drives for the pinch rolls and for the straightening rolls, FIG. 2 is a view in elevation on the operator's side of the straightener with part of the side frame broken away to better illustrate the pivot plates for the pinch and straightening rolls, FIG. 3A is a vertical sectional view taken substantially on line 3A—3A of FIG. 2 and showing the journalling structures for the entrance pinch rolls in associated relation with the side frame of the straightener on the operator's side, FIG. 3B is a vertical sectional view taken substantially on line 3B—3B of FIG. 2 and showing the journalling structures for the entrance pinch rolls in associated relation with the rear frame adjacent the gear box on the left side of the straightener, FIG. 4A is a vertical section view taken substantially on line 4A—4A of FIG. 2 and showing the journalling structures for the upper and lower straightening rolls in associated relation with the side frame on the operator's side, FIG. 4B is a section view taken substantially on line 4B—4B of FIG. 2 and showing the journalling for the straightening rolls in associated relation with the rear side frame adjacent the gear box, FIG. 5 is an exploded view in perspective showing one of the bearing structures for the upper movable pinch rolls, the same incorporating a bearing within a bearing, FIG. 6 is a view in perspective showing one of the bearing structures for the upper movable straightening rolls withdrawn from a straightener and shown in an exploded arrangement for better illustrating the various parts of the bearing, FIG. 7 is a schematic view in elevation showing the pass gauge line and the association therewith of an indicator plate on an upper movable straightening roll, and FIG. 8 is a schematic diagram illustrating the pivotal action of an upper movable straightening roll and its function in straightening a strip of metal stock.

Referring to the drawings and in particular to FIGS. 1, 3B and 6, it will understood that the straightener of the invention receives a strip of metal stock material 11 at its entrance end FIG. 6, and after the strip has been worked and straightened by passing through the machine it is ejected at the exit end which end is shown in elevation in FIG. 1. The pinch rolls at said end are designated by numeral 20 for the upper movable roll and by numeral 22 for the lower pinch roll. The strip of material enters the straightener by passing between the entrance pinch rolls 12 and 14 and then the same is straightened by the plurality of straightening rolls 15, 16, 17, 18 and 19, FIG. 2, and finally the strip leaves the machine by passing between the exit pinch rolls 20 and 22 as above identified. All the lower rolls are mounted for rotation in bearings located in the side frames 23 and 24 and all the upper movable rolls are mounted for rotation in bearings located in pivot plates having pivotal securement to the side frames respectively, as will be presently described in detail. The side frames are supported by the supporting structure including the members 25 and 26. The gear box 27 is supported by member 25 and said gear box has an input drive shaft 28 and a plurality of output drives, not shown, which are connected to the rolls by the Schmidt couplings 30 for the upper movable rolls and by the standard couplings 31 for the lower rolls. The couplings 30 have off-set driving characteristics as more particularly shown and described in U.S. Pat. No. 4,083,217 granted Apr. 11, 1978 and entitled Overlapping Gear Drive For Straightening Machines.

The pair of pinch rolls 12 and 14 at the entrance end and the pair of pinch rolls 20 and 22 at the exit end are substantially similar in all structural respects. As shown in FIG. 3B for frame 23, the coupling 30 from the gear box 27 is connected by keying 32 to extension 33 of the shaft 34 for the upper pinch roll 12. The coupling 31 is also keyed at 35 to extension 36 of the shaft 37 for the lower entrance pinch roll 14. The shaft is also provided with a bearing portion 38 between the extension 36 and the shaft proper 37. On the operator's side of the straightener and associated with the side frame 24, the shaft 34 for roll 12 has only the bearing portion 40 and in a similar manner the shaft 37 for roll 14 has only the bearing portion 41 extending from the same. On this side, which is the operator's side, the plastic guard or shield 42 is releasably secured to the frame 24. All the pinch rolls have a knurled periphery and they are caused to rotate in unison and to a like extent by the drives provided by the gear box 27.

BEARINGS FOR THE LOWER PINCH ROLLS

The lower pinch rolls 14 and 22 are journalled in the side frames 23 and 24 by bearings as shown in FIGS. 3A and 3B. It will be understood that the bearing structures shown in said Figures are duplicated for the pinch roll 22. The bearing portion 38 retains the inside bearing race 43 which accomodates the roller bearings 44 confined between race 43 and the outside race 45. The bearing unit is housed within the cylindrical bearing retainer 46 located in the side frame 23 and closed by the oil sealing plates 47 and 48. A locking member 49 is threadedly secured to the end of the bearing portion 38. Beyond the bearing structure the extension 36 is suitably connected to the standard coupling 31. At the opposite end of roll 14, the bearing portion 41 retains the inside bearing race 50 having the roller bearings 51 confined between it and the outer race 52 with the unit being housed within the bearing retainer 53 located in the side frame 24. Said bearing retainer on its inside has secured thereto the oil sealing plate 54 and on the outside the cap member 55 is secured to the bearing retainer. The locking member 56 is threadedly secured to the end of the bearing portion 41 and accordingly retains the inside bearing race 50 in place on said bearing portion. The circular openings 57 in the side frames 23 and 24 are just slightly larger in diameter than that of the pinch rolls and it is therefore possible to remove the pinch rolls through said openings in the frame 24 on the operator's side. In all cases the bearing retainer must be removed but its removal and work on any one bearing does not adversely affect the remaining bearing structures. It is also possible to remove the bearing structures for the pinch rolls on the gear box side without removing the gear box.

BEARINGS FOR THE LOWER STRAIGHTENING ROLLS

The bearings for the lower straightening rolls as shown in FIGS. 4A and 4B are also located in the side frames 23 and 24 and the bearing structures for roll 18 are duplicated for roll 16 and likewise the bearing structures for roll 19 are duplicated for the lower straightening rolls 15 and 17. The shaft 60 for roll 19 has the bearing portion 61 and the extension 62 extending from the same on the gear box side, the extension connecting with the coupling 31 which in turn connects the shaft with one of the drives such as 29 provided by the gear box 27. The inside bearing race 63 on portion 61 accommodates the roller bearings 64 which are confined between the inside race and the outside race 65. The bearing unit is housed within the bearing retainer 66 located within the side frame 23. The inside wall of the bearing retainer 66 provides an oil seal 67 and an oil sealing plate 66 is secured to the opposite gear box side. The threaded locking ring 69 secured to the end of the portion 61 for locking the inside race 63. On the opposite end of roll 19, on the operator's side, the shaft 60 has only the bearing portion 70 formed on the same and said portion receives the inside race 71, the roller bearings 72 and the outside race 73. The bearing unit is housed within the bearing retainer 74 located in side frame 24. The outside wall of retainer 74 provides an oil seal 75 and the cap member 76 seals the operator's end of the shaft with the bearing unit being locked by the threaded locking ring 77. As regards the lower straightening rolls 15, 17 and 19 they can be removed through openings 78 in the side frame 24 on the operator's side which have a diameter slightly larger than that of the roll. Work on any one roll and its removal does not adversely affect the others.

BEARINGS FOR THE UPPER MOVABLE PINCH ROLLS

Referring again to FIGS. 3A and 3B it will be seen that the bearings for the upper movable pinch rolls 12 and 20 are located inside in staggered relation to the bearing structures for the lower pinch rolls 14 and 22. Whereas the bearing structures for the lower pinch rolls are located in the side frames 23 and 24, the upper pinch roll bearings are located in pivot plates 80 for roll 12 at the entrance end and pivot plates 81 at the exit end for roll 20, see FIG. 2. Each pair of pivot plates are respectively mounted on the side frames to the inside of the frames by pivot pins 82 and 83 and each pivot plate carries journalling structure for its particular pinch roll, which will now be described.

The shaft 34 for pinch roll 12 provides the bearing portion 39 and the same carries the inside bearing race 84, the roller bearings 85 and the outside race 86. The bearing unit is housed in the bearing retainer 87 located in the pivot plate 80 on the gear box side and which plate is pivoted by a pin 82 to side frame 23 and to the inside of said frame. The retainer 87 provides an oil seal 88 on the shaft side and is closed on its gear box side by the oil sealing plate 89. The locking ring 79 is threaded to the end of portion 39 to retain the bearing race 84 in place. The opposite end of shaft 34 as shown in FIG. 3A has portion 40 on which is mounted the inside bearing race 90, the rollers 91 and the outside bearing race 92. The bearing unit is housed within the bearing retainer 93. On the inside the retainer carries the oil sealing plate 94 and on its outside the cap plate is secured thereto, designated 95 to which is fixed the extension 96 cylindrical in form for retaining the indicator plate 97. The locking ring 98 is threaded to the end of portion 40 being located inside of cap plate 95. The indicator plate is circular having the same size as the upper pinch roll 12 and the operator by observing the indicator plates on the upper movable rolls can easily visualize the position of the rolls with respect to the pass gauge line 100, FIG. 2.

The bearing structures of FIGS. 3A and 3B support and journal the pinch roll 12 for approximately vertical up and down movement towards and from the lower pinch roll 14, and in accordance with the invention each structure incorporates a bearing within a bearing. The journal for the right hand bearing portion 40 of roll 12 additionally includes, as shown in FIG. 5, a bearing ring 101 which has encircling relation with the housing retainer 93. A A clevis extension 102 is provided by the ring and a clevis 103 is pivotally joined to the extension by the clevis pin 104. For elevating and lowering roll 12 each end is powered by a power cylinder 105 of the hydraulic type which provides a depending piston rod 106 having a threaded connection with its clevis 103. Pivot plates, as previously stated, carry the journalling bearings for the upper movable rolls and it will be observed from FIG. 5, that pivot plate 81 for roll 20 on the operator's side consists of two parts 81L and 81R, being disposed on respective sides of the bearing ring 101. Each part of the pivot plate has an opening 107 in the same for receiving the bearing ring 101 and which in turn receives the bearing retainer 93 for this particular end of the shaft. Half of the bearing ring 101 as regards its width is located in pivot plate 81L and the other half is located in pivot plate 81R. This locates the clevis extension 103 substantially centrally of the two part pivot plate and the individual parts are cut away at 108 to accomodate the clevis extension. The pivot pin 83 for plate 81, and likewise for the other pivot plates, passes through both sections and then through the side frame to receive the locking nut 110. The individual parts of the pivot plate 81 are connected in assembled relation, as regards the bearing ring 101, by the securing screws 111 and the two part pivot plate is accordingly joined as a unit with freedom for the bearing ring to rock back and forth to a limited extent. The openings 107 are sufficiently large in diameter to allow the upper pinch roll to be withdrawn and which is also made possible by the hexagonal shaped opening 112 in the side frame 24. The roll can be passed through the openings 107 and 112 without removing the pivot plate. However the pivot plate can also be released and likewise removed through the opening 112. The structures are the same for both pinch rolls 12 and 20 on the operator's side.

The upper pinch roll 20 for an example is elevated and lowered by the power cylinders 105 which activate respective ends of the roll, the motion from the piston rods 106 being transmitted to the ring members 101 and through the ring members to the journalling bearings and then to the rolls and their pivot plates. The piston rods have vertical straight line movement. However, the pivot plates have pivotal movement and thus the bearing rings 101 with freedom of rocking movement are a necessity. This has been previously described as a bearing within a bearing, namely, the bearing retainer 93 for this end of the roll, being located within the bearing ring 101, and said bearing ring being located within and being capable of rocking movement with respect to the pivot plate 81. FIG. 8 illustrates the pivotal action of the plates and this Figure will be presently explained in connection with the movable straightening rolls.

Since the power cylinders 105 on respective sides of the pinch roll are independent of each other, the piston rods 106 are free to move up and down to a greater or less extent. If this were allowed to take place the several parts would probably bind and in addition the strip material passing between the pinch rolls would not be uniformily pinched for the best feeding action. Therefore, the invention ties the two bearing structures and the two pivot plates together by the connecting bridge member 114 which performs a leveling action, such as a levelator, on the respective ends of the movable pinch rolls. The connecting bridge 114 is secured to each of the pivot plates and more specifically to the two part sections of each pivot plate. The securing screws 115 secure the bridge member to the half section 81L of plates 81 and securing screws 116 secure the bridge member to the half section 81R of said plates 81. As a result of the connecting bridge member the power cylinders will act in unison and to a like extent in elevating and lowering the upper movable pinch rolls.

BEARINGS FOR THE UPPER MOVABLE STRAIGHTENING ROLLS

The journalling structures for the upper movable straightening rolls 16 and 18 are shown in FIGS. 4A and 4B and roll 18 has been selected for specific description as regards both the bearing structures and the jack screw mechanisms which are employed for the straightening rolls in the place of power cylinders. The shaft 120 for roll 18 on the gear box side is provided with a bearing portion 121 and with an extension 122 which is keyed at 123 to the connector 124 of the Schmidt coupling 30. The inside bearing race 125 is mounted on the bearing portion 121 and the roller bearings 126 are confined between the same and the outside race 127. The said journalling unit is housed within the bearing rings 128 having the clevis extension 130 as best shown in FIG. 6. The bearing ring is closed on its shaft side by the oil sealing plate 131 and on the gear box side by the cylindrical cap member 132 which is secured to the ring thus closing this side of the bearing unit. The cap member also provides an oil seal and the locking ring 133 is threadedly secured to the end of the bearing portion. The bearing ring 128 encircles and contains the outside bearing race 127 and the bearing ring in turn is carried and contained by the pivot plate 135 for this end of the roll. The pivot plate is pivotally secured to the side frame 23 by the pivot pin 136, being located inside of said frame member. The clevis extension 130 is pivotally secured by the clevis pin 137 to the depending actuating screw 138 of the jack screw arrangement 140.

The bearing structure for shaft 120 on the operator's side FIG. 4A and 6 is substantially as above described with the shaft at this side providing a journalling portion 141 on which is mounted the inside bearing race 142. The roller bearings 143 are confined between the inside race and the outside bearing race 144 which is located within the bearing ring 145, the ring encircles the outside race and provides the clevis extension 130 all as described. The shaft side of the bearing unit is sealed by the sealing plate 146 and the other side is closed by the cylindrical extension 147 to which is secured the indicator plate 148. The locking ring 149 is threaded to the end of the journalling portion 141. The bearing ring 145 having the clevis extension 130, houses and contains the roller bearing unit and the bearing ring is in turn contained in and carried by the pivot plate 135 for this the operator's side. The pivot pin 136 pivotally secures the pivoy plate 135 to the inside of the frame member 24 and the said plate is operatively connected by means of the clevis extension 130 and the clevis pin 137 to the depending jack screw 138 of the jack screw arrangement 140.

OPERATION

Reference is made to FIGS. 6, 7 and 8 for an understanding of the operation of the present straightener wherein it will be observed that a strip of metal 11 to be straightened is caused to enter between the entrance rolls 12 and 14 and after passing over straightening roll 15, under roll 16, over roll 17, under roll 18 and over roll 19, the strip is ejected from the straightener by passing between the exit pinch rolls 20 and 22. The upper movable pinch rolls can be powered in a down direction by the power cylinders 105 and by this action the bite on the metal strip passing between the pinch rolls can be intensified. The bearings for the pinch rolls are staggered with the bearings for the upper movable rolls being located to the inside of the bearings for the lower pinch rolls. This makes possible an increase in roll bearing size without an increase in roll size. The invention employs pivot plates such as 81L and 81R designed to be assembled and which are pivotally secured as at 111 to a side frame. The invention additionally provides a bearing within a bearing as best shown in FIG. 5. The pivot structure can accordingly be powered by the piston rod of a power cylinder which moves up and down in a straight line action with the arcuate movement required by the pivot plate being taken by the inventive feature of a bearing within a bearing. The limited rotative movements of the bearing 101 for example requires the clevis 103 which is pivotally connected to the clevis extension 102 on the said bearing.

For straightening purposes the metal strip 11 passes over a lower straightening roll and then under an upper straightening roll and then over again and so on as shown in FIG. 8. The said figure also illustrates the arcuate movement of a upper straightening roll by reason of its supporting pivot plates. The various components of a bearing unit for an upper movable straightening roll is shown in FIG. 6, the components being separated and being shown in exploded form. Here also the inventive feature of a bearing within a bearing is employed. This makes possible the use of the jack screw arrangements which move up and down in a straight line action similar to the piston rods of a power cylinder. As best shown in FIG. 4B, the bearing units for the upper movable straightening rolls are staggered with respect to the bearing units for the lower straightening rolls being located inwardly of the latter. The advantages here are the same as for the pinch rolls. A straightener having larger bearings for the same roll size is able to work on strip material of increased thickness. It is also possible as regards the straightening rolls to remove them together with their bearing units, at least on the operator's side, by passing the same through the openings provided therefor in the side frame.

The bearing units for the upper movable straightening rolls 16 and 18 and also the bearing units for the lower rolls 15, 17 and 19 have indicator plates associated therewith and which are axially aligned with their respective roll and are also substantially the same size in diameter as their respective roll except for the plate 148, FIG. 7. The indicator plates are located on the operator's side of the straightener and in conjunction with the pass gauge line 100, they visually indicate to the operator the position and in particular the down position of the upper rolls with respect to the lower rolls. This down position of the upper movable rolls is a measure of the bending to which the strip is being subjected as it passes through the machine.

FIG. 8 illustrates the maximum down position of roll 16 for bending a strip of material as shown. This figure also illustrates the arcing of the rolls in their up and down movements by reason of the pivot plates which support the rolls for such movements. FIG. 7 shows another feature of the invention wherein the indicator plate 148 on roll 18 is somewhat greater in diameter than the roll so as to provide space for the indicia 150. The indicia occupies the circumferential portion of the indicator plate beyond the zero pass line and accordingly the indicia indicates to the operator the approximate thickness of the strip being worked on.

I claim:

1. A straightening machine for bending and straightening metal stock, the combination with spaced side frames, of a lower pinch roll located at the entrance and also at the exit end of the machine, bearing units for each lower pinch roll having location in the side frames for mounting the pinch roll for rotation, an upper movable pinch roll for each lower pinch roll, pivot plates in pivotally connected relation with each side frame and having location adjacent the inside surface of a side frame, other bearing units for each upper movable pinch roll, said other bearing units having a fixed location in the pivot plates respectively, for journalling the upper movable pinch rolls and which accordingly have bodily movement when the pivot plates are actuated, the said bear-units for each upper movable roll having a staggered relation with respect to the bearing units for their associated lower roll since the latter bearing units are located in the side frames whereas the bearing units for the upper movable rolls are located in the pivot plates.

2. In a straightening machine of the character described, the combination with spaced side frames, of a pair of pinch rolls at the entrance end and also at the exit end of the machine, a plurality of straightening rolls located between and including at least two lower straightening rolls and one upper movable straighten roll, bearing units for the two lower straightening rolls and which are located in the side frames respectively, for mounting the lower rolls for rotation, pivot plates having a pivotally connected relation with the side frames and being located inwardly of the side frames adjacent an inside surface, other bearing units having location in the pivot plates respectively, for mounting the upper movable straightening roll for rotation and for bodily movement upon pivotal movement of the pivot plats, power means providing a depending member adapted to move up and down in a precisely vertical path, each said other bearing units incorporating a bearing member within a bearing member, and means pivotally connecting the depending end of said depending member with the inside bearing member, whereby movement can be imparted to the upper movable straightening roll notwithstanding the arcuate movement of said roll caused by the pivot plates.

3. A straightening machine of the character described by claim 2, wherein the second mentioned bearing member includes the pivot plate and which has the inside bearing member located in an opening provided by the same, a clevis extension projecting from the inside bearing member, and the said means which pivotally connects the depending member with the inside bearing member having associated relation with the clevis extension.

4. A straightening machine of the character as described by claim 2, wherein each said pivot plate is sectional including two half sections disposed on respective sides of the inside bearing member, and a clevis extension projecting from registered slots provided by the half sections, the said means which pivotally connects the depending member with the inside bearing member having associated relation with the clevis extension.

5. In a straightening machine of the character described, the combination with spaced side frames, of a pair of pinch rolls located at respective ends of the machine including lower pinch rolls and upper movable pinch rolls, a pair of bearing units for each lower pinch roll having location in the side frames respectively, for journalling the lower pinch rolls for rotation, a plurality of straightening rolls located between the pairs of pinch rolls, said straightening rolls including lower rolls and at least one upper movable roll, a pair of pivot plates for each upper movable roll, other bearing units located in the pivot plates for journalling their particular movable roll and for supporting the same for bodily movement, a reciprocable power means for each said other bearing units having operative connected relation therewith, said reciprocable power means for the bearing units comprising power cylinders as regards the upper movable pinch rolls and comprising jack screw arrangements as regards the upper movable straightening rolls.

6. A straightening machine of the character described by claim 5, wherein said other bearing units incorporate a bearing member within a bearing member, said second mentioned bearing member for each bearing unit comprising the pivot plate and the first mentioned bearing member comprising a ring-like element having a clevis extension projecting from the same, and wherein the reciprocable power means is operatively connected to the clevis extension for its particular bearing unit.

7. A straightening machine of the character described by claim 5, wherein each pivot plate is sectional including two half sections disposed on respective sides of the first mentioned bearing member, wherein the clevis extension projects from registered slots provided by the half sections, and additionally including a pivoy pin for operatively connecting the reciprocable power means with its particular clevis extension.

8. In a straightening machine of the character described, the combination with spaced side frames, of a pair of pinch rolls located at respective ends of the machine including lower pinch rolls and upper movable pinch rolls, means located in the side frames for mounting and journalling the lower pinch rolls for rotation, a plurality of straightening rolls located between the pairs of pinch rolls and including lower straightening rolls and at least one upper movable straightening roll, a pair of pivot plates for each upper movable roll, means pivotally securing each pivot plate to a side frame adjacent the inside surface of the side frame, a bearing unit at each end of each of the upper movable straightening rolls, said bearing units respectively having location in the pivot plates for mounting and journalling their particular roll for rotation and for pivotal movement about said means as an axis, power means for each bearing unit providing a member capable of reciprocation, and a clevis connection for each of said bearing units joining the same with said member of its particular power means.

9. A straightening machine of the character as described by claim 8, where at least one side frame has openings in the same in alignment respectively with each of the lower and upper rolls, each opening having a diameter just slightly larger than the roll aligned therewith, and wherein the bearing units when assembled on the roll axle have an over-all diameter the same as the roll, whereby the roll and its bearing units can be assembled and removed from the machine by passing the same through its aligned opening and which can take place without disturbing the remaining rolls.

10. A straightening machine of the character as described by claim 8, additionally including other pivot plates pivotally secured adjacent the inside surface to the side frames respectively, other bearing units located in the other pivot plates for mounting and journalling at each end of the machine the upper movable pinch rolls, and a bridge member connecting the respective bearing units at the ends of each upper movable pinch roll, said bridge member functioning as a levelator for its particular pinch roll.

11. A straightening machine of the character as described by claim 8, additionally including an indicator plate in associated relation with each bearing unit and located on the side of the roll adjacent the side frame having the openings, the indicator plates having an aligned relation with their roll and the majority having a diameter equal to that of its roll, whereby the indicator plates simulate the rolls in operation and give the operator an indication of the position of the straightening rolls with respect to a pass gauge line extending from the bight of the pinch rolls at the entrance end of the machine to the bight of the pinch rolls at the exit end.

12. In a straightening machine of the character described, the combination with spaced side frames, of a pair of pinch rolls located at the entrance and exit ends of the machine and including a lower pinch roll and an upper movable pinch roll, a plurality of straightening rolls located between the entrance and exit pinch rolls and including lower straightening rolls and upper movable straightening rolls, a pair of pivot plates for each upper movable straightening roll, pivot means securing each pivot plate to a side frame adjacent the inside surface of the same, a bearing unit on each end of each straightening roll and having location in a pivot plate, whereby the straightening rolls are supported by the pivot plates for rotation and for bodily movement, an indicator plate in associated relation with those bearing units located adjacent one of the side frames, each indicator plate being in alignment with its roll and having a diameter about the same as the roll, whereby the indicator plates simulate the rolls in operation and give the operator an indication of the position of the straightening rolls with respect to a pass gauge line extending from the bight of the pinch rolls at the entrance end of the machine to the bight of the pinch rolls at the exit end.

13. A straightening machine of the character described by claim 12, additionally including power means in operative connected with each of the bearing units on each movable straightening roll, and wherein each said connected relation between a power means and a bearing unit includes a bearing within a bearing, a clevis extension provided by the first mentioned bearing, and a pivot pin joining the clevis extension with its particular power means.

14. A straightening machine for bending and straightening metal stock as defined by claim 1, additionally including a plurality of straightening rolls including lower rolls and upper movable straightening rolls, additional bearing units having location in the side frames for journalling the lower straightening rolls, additional pivot plates in pivotally connected relation with the side frames and having location adjacent the inside surface of a side frame, still other additional bearing units located in the pivot plates for journalling the upper movable straightening rolls and for supporting the same for pivotal movement, and power means in operative connected relation respectively, with the last mentioned bearing units having location in the pivot plates for actuating the said pivot plates and the rolls supported thereby.

* * * * *